US011092043B2

(12) United States Patent
Popp

(10) Patent No.: US 11,092,043 B2
(45) Date of Patent: Aug. 17, 2021

(54) SWITCHABLE CAM LEVER

(71) Applicant: Schaeffler Technologies AG & Co. KG, Herzogenaurach (DE)

(72) Inventor: Oliver Popp, Hirschaid (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/965,316

(22) PCT Filed: Jan. 7, 2019

(86) PCT No.: PCT/DE2019/100005

§ 371 (c)(1),
(2) Date: Jul. 28, 2020

(87) PCT Pub. No.: WO2019/144985

PCT Pub. Date: Aug. 1, 2019

(65) Prior Publication Data

US 2021/0115818 A1 Apr. 22, 2021

(30) Foreign Application Priority Data

Jan. 29, 2018 (DE) ..... 10 2018 101 868.1

(51) Int. Cl.

| | |
|---|---|
| ***F01L 1/34*** | (2006.01) |
| ***F01L 1/18*** | (2006.01) |
| ***F01L 1/46*** | (2006.01) |

(52) U.S. Cl.

CPC ..... *F01L 1/185* (2013.01); *F01L 1/46* (2013.01); *F01L 2001/186* (2013.01); *F01L 2001/467* (2013.01)

(58) Field of Classification Search

CPC ..... F01L 1/185; F01L 1/46; F01L 2001/186; F01L 2001/467; F01L 2305/00

See application file for complete search history.

(56) References Cited

U.S. PATENT DOCUMENTS

| | | | |
|---|---|---|---|
| 7,201,126 | B1 | 4/2007 | Seitz |
| 2001/0023675 | A1 | 9/2001 | Lee et al. |
| 2003/0209216 | A1 | 11/2003 | Kreuter |

(Continued)

FOREIGN PATENT DOCUMENTS

| | | | |
|---|---|---|---|
| DE | 10137490 | A1 | 2/2003 |
| DE | 10220904 | A1 | 11/2003 |

(Continued)

*Primary Examiner* — Zelalem Eshete
(74) *Attorney, Agent, or Firm* — Matthew Evans

(57) ABSTRACT

A switchable cam lever that includes an inner lever and an outer lever is provided for a valve drive of an internal combustion engine. A transverse coupling serves for connecting the outer and inner lever to one another. A cam return spring is braced between the outer and inner lever. The return spring is installed upright, wherein the coupling runs directly above a support surface, and the return spring, as viewed in a lever longitudinal direction is guided in a receptacle in the inner lever. The receptacle is situated directly and entirely in front of the support surface and is formed as a bore, and the return spring bears at one end against a base or annular collar of the bore and acts at an opposite end against a crossbar which connects two arms of the outer lever at the top side.

20 Claims, 1 Drawing Sheet

(56) References Cited

U.S. PATENT DOCUMENTS

| | | | | |
|---|---|---|---|---|
| 2004/0206324 | A1* | 10/2004 | Artmann | F01L 13/0015 123/90.39 |
| 2010/0236508 | A1 | 9/2010 | Kang | |
| 2013/0146008 | A1 | 6/2013 | Stoody | |

FOREIGN PATENT DOCUMENTS

| | | | |
|---|---|---|---|
| DE | 102004029555 | A1 | 1/2006 |
| DE | 102005048984 | A1 | 4/2007 |
| DE | 102010011421 | A1 | 9/2010 |
| DE | 102014108598 | A1 | 12/2015 |
| EP | 2050933 | A1 | 4/2009 |
| WO | 2013067506 | A1 | 5/2013 |

* cited by examiner

SWITCHABLE CAM LEVER

CROSS-REFERENCE TO RELATED APPLICATIONS

This application is the U.S. National Phase of PCT Application No. PCT/DE2019/100005 filed on Jan. 7, 2019 which claims priority to DE 10 2018 101 868.1 filed on Jan. 29, 2018, the entire disclosures of which are incorporated by reference herein.

TECHNICAL FIELD

This disclosure relates to a switchable rocker lever for a valve drive of an internal combustion engine.

BACKGROUND

A generic rocker lever is known from FIGS. 1 to 6 of US2013/0146008 A1. The rocker lever is constructed in the form of a case and has at one end a pivot axle, on which the inner and outer lever rest. At a lower side at one end, the outer lever has two gas exchange valve abutments. At the other end, the outer lever has two support faces for support elements at the lower side thereof. As shown in FIG. 5 in this instance, there are located, when viewed in the lever longitudinal direction from one end to the other, behind the support faces transversely extending coupling sliding means and in front of the support faces (see also FIGS. 2, 3) a vertically installed helical pressure spring as a cam return resilient means. The helical pressure spring rests in a pocket-like protrusion above the upper side of the inner lever and acts with the lower end thereof on a collar-like shoulder of the outer lever below the lower side.

Another rocker lever, in this instance in the form of a cam profile switching rocker lever is disclosed in DE 10 2005 048 984 A1. The cam return resilient means thereof which is constructed in an upright manner (helical pressure spring), also called the lost motion spring, is located in this instance at one end on the valve shaft abutment. The helical pressure spring is clamped between a cantilever arm of the inner lever protruding from the upper side and a crossbeam of the outer lever. In order to displace the coupling sliding means in one direction, a hydraulic medium pressure is used.

It is disadvantageous with the last rocker lever mentioned above that the helical pressure spring abuts the free pivot end of the rocker lever. Consequently, the mass inertia is unnecessarily increased. On the other hand, the helical pressure spring does not have sufficient guiding and fixing or complex measures have to be taken for this purpose. At the same time, the rocker lever is unnecessarily high at the valve side so that, with current compact internal combustion engines, there may inter alia be collision problems with surrounding components. In addition, it is determined that, as a result of the comparatively short lever arm, an unnecessarily strong helical pressure spring has to be constructed.

In addition, reference may be made to DE 102 20 904 A1. Between the lever components visible, for example, in FIG. 3, two upright helical pressure springs act on the other end at the support face of the inner lever. The helical pressure springs are constructed at the side of the support face.

Other switchable rocker levers with upright helical pressure springs can be seen in documents DE 10 2010 011 421 A1, DE 101 37 490 A1 and EP 2 050 933 A1.

SUMMARY

An object is to produce a compact and simply constructed and easy-to-assemble switchable rocker lever.

According to the disclosure, this object is achieved in that the coupling extends directly above the support face. The helical pressure spring, when viewed in the lever longitudinal direction from one end to the other, is guided in a receptacle in the inner lever which is located directly and completely in front of the support face. The receptacle is constructed as a bore and one end of the helical pressure spring abuts a base or annular collar of the bore facing the lower side. Another end of the helical pressure spring acts against a curved crossbar which connects the arms of the outer lever at the upper side. The crossbar is guided in two diametrically opposed longitudinal slots of the inner lever which intersect with the receptacle. When the curved crossbar abuts the base of the longitudinal slots, the outer lever is subjected to an outward rotational limitation with respect to the inner lever in the uncoupling mode.

Consequently, a rocker lever is provided without the above-mentioned disadvantages. The vertical helical pressure spring extends directly at the pivot center of the rocker lever in a bore or similar type of opening. At the same time, the spring is subjected to a simple guiding and support. The lever additionally takes up little structural height and, as a result of the transversely extending coupling which is accommodated above the support face, less structural length.

Consideration is given particularly but not exclusively as the support face to a dome-shaped formation in the lower side of the inner lever, via which the rocker lever can be supported on a head of a support element. However, a rotary articulation or the like is also conceivable in this instance.

The helical pressure spring is additionally clamped in a very simple manner and rests with the lower end thereof on a base or an annular collar of the bore thereof in the internal element. Where applicable, the bore may also be continuous and a subsequently applied securing ring or the like is provided as a lower abutment. The upper clamping of the cam return spring (lost motion spring) is advantageously carried out at a lower side of a curved crossbar of the outer lever, which curved crossbar extends from the arms thereof and spans the upper side of the inner lever. In this instance, the curved crossbar is guided in longitudinal slots of the inner lever in the bore and is subjected to an abutment against base faces of the longitudinal slots. Consequently, structural height is saved. At the same time, there is an additional lateral guiding of the two lever portions and a simple outward rotational limitation of the outer lever with respect to the inner lever in the uncoupling mode is provided.

In order to act on the coupling which extends transversely above the support face, an external means, such as, for example, an electromagnetic servo means, in at least one displacement direction of the total of at least two pins may advantageously be considered as the coupling. To this end, a direct action of an actuator on an outer end face of the second pin which rests in the bore of the outer lever is conceivable and provided. Alternatively, the second pin may also be contacted, for example, by a transmission member such as a resilient tongue which is connected to a centrally electromagnetically operated sliding rail in the cylinder head.

A restoration of the pin bundle in the inner and outer lever can be carried out by means of pressure spring force when the cam passes through the base circle, the pressure spring being arranged in front of the first pin or surrounding it. Alternatively, both displacement movements of the pin bundle can also be carried out by means of an electromagnetic servo means.

DETAILED DESCRIPTION OF THE EMBODIMENTS

Figure 1:
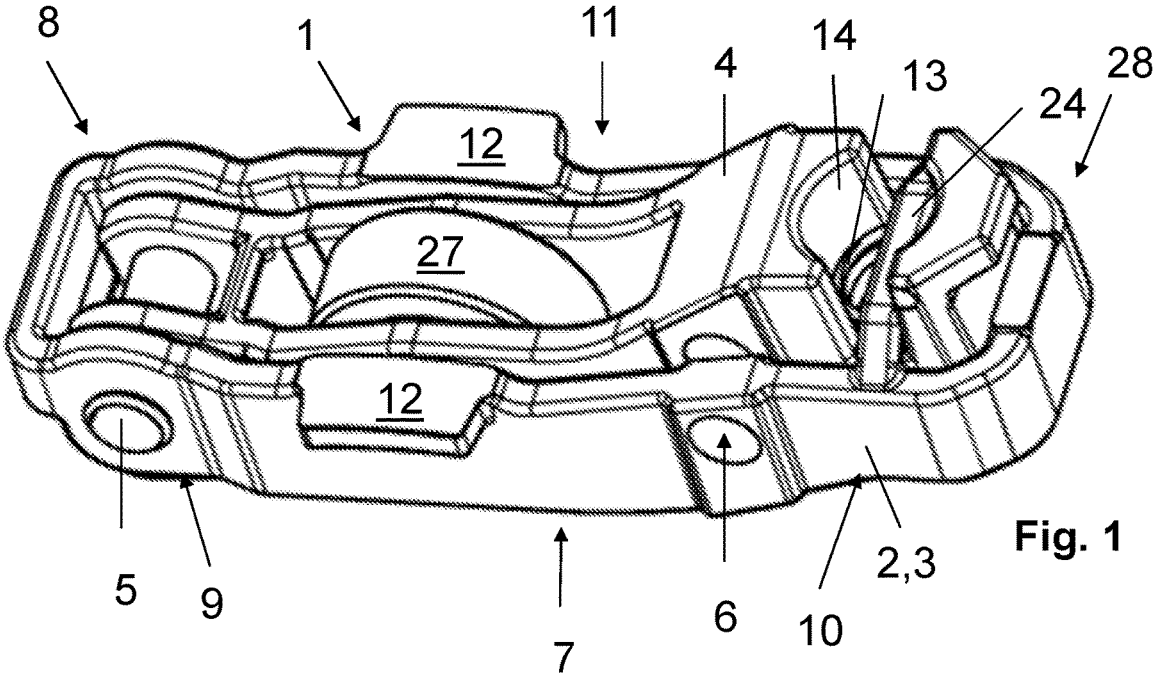
FIG. 1 is a spatial view of the rocker lever.
Figure 2:
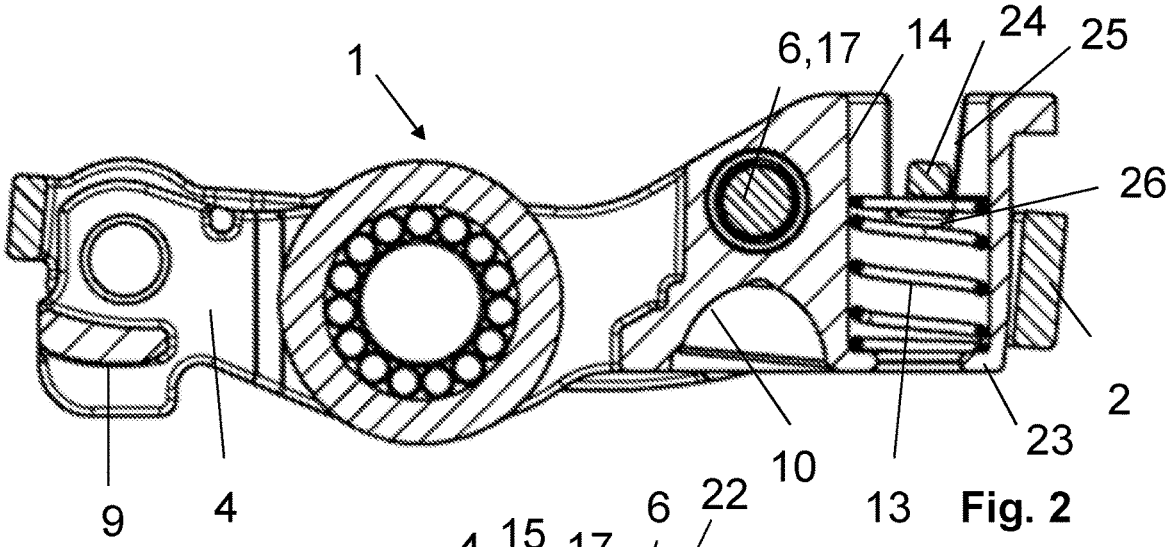
FIG. 2 is a longitudinal section therethrough.

FIGS. 1, 2 show a switchable rocker lever 1 for a valve drive of an internal combustion engine, in this instance for cam profile switching.

The rocker lever 1 has a box-like outer lever 2, between the arms 3 of which there is located an inner lever 4 in a pivotably movable manner relative thereto. In this instance, the outer lever 2 has at an upper side 11 two cam contact surfaces 12 which are provided as sliding interfaces for high-lift cams. The inner lever 4 in contrast has a roller as a cam contact surface 27 for a low-lift cam.

The outer and inner levers 2, 4 rest on a pivot axle 5 at one end 8 thereof. At a lower side 7 of the inner lever 4 (see FIG. 2), at one end 8 a gas exchange valve abutment 9 is illustrated. At another end 28, the inner lever 4 has a support face 10 which is in the form of a dome for support of a support element.

Furthermore, in FIGS. 1, 2 a cam return resilient means 13 which is in the form of a helical pressure spring is illustrated. This means 13 extends in this instance in an "upright" manner, that is to say, from the upper side 11 in the direction toward the lower side 11, 7, and rests in a bore-like receiving member 14 or a reception bore of the inner lever 4 which is located directly after the support face 10 when viewed in the lever longitudinal direction from one end to the other end 8, 28. In this instance, the helical pressure spring 13 is supported at one end on an annular collar 23 facing the lower side 7. At the other end, it forcibly acts against a curved crossbar 24 which connects the arms 3 of the outer lever 2 at the upper side 11. This crossbar 24 may be in the form of a separate component and, for example, welded to the upper longitudinal sides of the outer lever 2. Alternatively, the curved crossbar 24 may also be in the form of an integral component of the outer lever 2.

For selective coupling/uncoupling of the two levers 2, 4 from each other, there is provided a transversely extending coupling 6, which is located directly above the support face 10. In this instance, the inner lever 4 has a continuous main bore 15 with a first pin 17 which extends continuously from bore end to bore end. The first pin 17, as can be seen more clearly in FIG. 3, is surrounded by a return guiding means 29 which is in the form of a pressure spring and is resiliently loaded according to FIG. 3 in the direction toward the right arm 3 of the outer lever 2.

The above-mentioned main bore 15, which is stepped in order to provide a single-ended abutment for the return guiding means 29, is in alignment in a non-pivoted basic position from the inner to the outer lever 4, 2 (cam base circle passage) with a continuous auxiliary bore 16 in the arms 3 of the outer lever 2. In the auxiliary bore 16 depicted on the right in FIG. 3, there is another pin 18. The protruding outer end face 19 thereof has a contact face for an external electromagnetic displacement means 20 for the pin bundle 18, 17 at the cam base circle passage in an inward direction. In this instance, an inner end face 21 of the additional pin 18 in the outer lever 2 is formed as a contact face for an opposing outer end face 22 of the first pin 17. The external displacement means 20 is indicated in FIG. 3 with a bold arrow.

Figure 3:
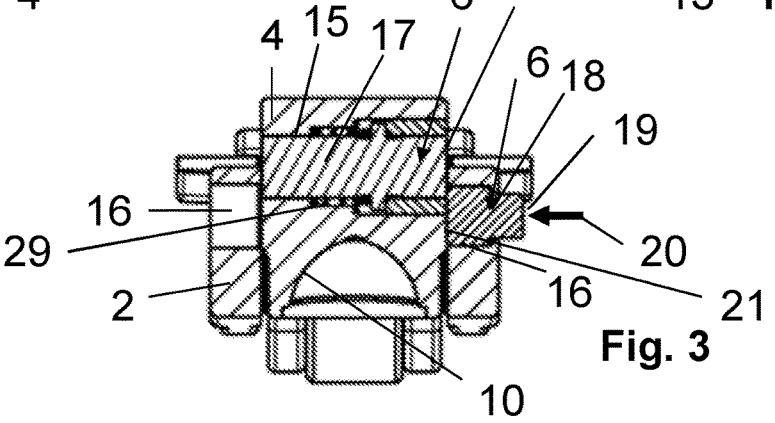
FIG. 3 is a cross-section in the region of the coupling thereof.

As can be seen in FIGS. 2, 3, the curved crossbar 24 initially mentioned is guided in two diametrically opposing longitudinal slots 25 of the inner lever 4 which intersect the receiving member 14. A respective base 26 provides the outer lever 2, as shown, with an outward rotational limitation with respect to the inner lever 4 in the uncoupling mode.

A coupling of the two lever portions 2, 4 is carried out in a well-known manner at the cam base circle passage, at which the lever portions 2, 4 are "unclamped" and the main and auxiliary bores 15, 16 thereof are in alignment with each other so that, when the additional pin 18 is acted on externally, it engages partially in the main bore 15 and in this instance displaces the first pin 17 partially into the auxiliary bore 16 of the left arm 3 which is depicted on the left in FIG. 3.

LIST OF REFERENCE CHARACTERS

1) Rocker lever
2) Outer lever
3) Arm
4) Inner lever
5) Pivot axle
6) Coupling
7) Lower side
8) One end
9) Gas exchange valve abutment
10) Support face
11) Upper side
12) Cam contact surface
13) Cam return resilient means, helical pressure spring
14) Receiving member, bore
15) Main bore
16) Auxiliary bore
17) First pin
18) Additional pin
19) Outer end face
20) Displacement means
21) Inner end face
22) Outer end face
23) Annular collar
24) Curved cross-member
25) Longitudinal slot
26) Base
27) Cam contact surface, roller
28) Other end
29) Return guiding means

The invention claimed is:

1. A switchable rocker lever for a valve drive of an internal combustion engine, the switchable rocker lever comprising:

an outer lever;

an inner lever disposed within a first longitudinal arm and a second longitudinal arm of the outer lever, the inner lever and the outer lever configured to rest on a pivot axle arranged at a first end of the switchable rocker lever;

a coupling arranged transversely to a longitudinal direction of the switchable rocker lever, the coupling configured to selectively couple the outer lever to the inner lever;

a lost motion spring arranged within a receptacle of the inner lever, the lost motion spring configured to forcibly act on a crossbar arranged on the outer lever, the crossbar arranged to: i) directly connect the first longitudinal arm to the second longitudinal arm; and ii) extend through the receptacle; and the coupling arranged: i) directly above a support face, the support face configured to support a support element; and ii) between the receptacle and the pivot axle in the longitudinal direction of the switchable rocker lever.

2. The switchable rocker lever of claim 1, wherein the crossbar defines a first opening between the crossbar and an end of the outer lever, and an end of the inner lever is disposed through the first opening.

3. The switchable rocker lever of claim 2, wherein the crossbar defines a second opening between the crossbar and the pivot axle and the coupling is disposed within the second opening.

4. The switchable rocker lever of claim 1, wherein the lost motion spring is arranged in an upright position.

5. The switchable rocker lever of claim 1, wherein the receptacle is configured with two diametrically opposed longitudinal slots that receive the crossbar.

6. The switchable rocker lever of claim 5, wherein a base of the longitudinal slots forms a stop for the crossbar.

7. The switchable rocker lever of claim 1, wherein the receptacle is a rotational stop for the switchable rocker lever.

8. The switchable rocker lever of claim 7, wherein the crossbar abuts with the rotational stop.

9. The switchable rocker lever of claim 1, wherein the coupling comprises:

a first pin arranged within a first bore of the inner lever, the first bore arranged parallel to the pivot axle;

a second pin arranged within a second bore of the outer lever; and coupling of the outer lever to the inner lever occurs via displacement of the second pin so that it engages the first bore and moves the first pin within a third bore of the outer lever.

10. The switchable rocker lever of claim 9, wherein the second pin includes:

an inner end face configured to engage the first pin; and an outer end face that protrudes outside of the second bore.

11. A switchable rocker lever for a valve drive of an internal combustion engine, the switchable rocker lever comprising:

an outer lever;

an inner lever disposed within the outer lever, the inner lever and the outer lever configured to rest on a pivot axle arranged at a first end of the switchable rocker lever;

a coupling arranged parallel to the pivot axle, the coupling configured to selectively couple the outer lever to the inner lever; and a lost motion spring arranged within a receptacle of the inner lever, a height of the lost motion spring limited by a crossbar of the outer lever, the crossbar arranged to abut with a rotational stop formed by the receptacle.

12. The switchable rocker lever of claim 11, wherein the rotational stop is formed by two diametrically opposed longitudinal slots of the receptacle.

13. The switchable rocker lever of claim 12, wherein the crossbar is configured to move within the longitudinal slots in an uncoupling mode of the switchable rocker lever.

14. The switchable rocker lever of claim 11, wherein the lost motion spring resides completely within the receptacle.

15. A switchable rocker lever for a valve drive of an internal combustion engine, the switchable rocker lever comprising:

an outer lever;

an inner lever disposed within the outer lever, the inner lever and the outer lever configured to rest on a pivot axle arranged at a first end of the switchable rocker lever, the inner lever having:

an exchange valve abutment at a pivot end;

a spring bore at an end opposite the pivot end, the spring bore extending from an upper side of the inner lever towards a lower side of the inner lever; and a support face configured to receive a support element; and a coupling arranged transversely to a longitudinal direction of the switchable rocker lever, the coupling configured to selectively couple the outer lever to the inner lever;

a lost motion spring arranged within the spring bore, a crossbar of the outer lever arranged to: i) compress the lost motion spring; and ii) move within the spring bore in a longitudinal direction relative to the spring bore.

16. The switchable rocker lever of claim 15, wherein the spring bore includes longitudinal slots that receive the crossbar.

17. The switchable rocker lever of claim 15, wherein the outer lever includes a first cam contact surface and a second cam contact surface, the first and second cam contact surfaces configured to engage high-lift cams.

18. The switchable rocker lever of claim 17, wherein the inner lever further comprises a roller configured to engage a low-lift cam, the roller arranged between the spring bore and the pivot axle.

19. The switchable rocker lever of claim 18, wherein the support face is arranged between the spring bore and the roller.

20. The switchable rocker lever of claim 19, wherein the coupling is arranged directly above the support face.

* * * * *